US008022342B2

(12) United States Patent
Kanechika

(10) Patent No.: US 8,022,342 B2
(45) Date of Patent: Sep. 20, 2011

(54) MICROWAVE SOURCE SYSTEM

(75) Inventor: Masayuki Kanechika, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 437 days.

(21) Appl. No.: 11/679,495

(22) Filed: Feb. 27, 2007

(65) Prior Publication Data

US 2007/0210052 A1 Sep. 13, 2007

(30) Foreign Application Priority Data

Mar. 7, 2006 (JP) ..... 2006-061147

(51) Int. Cl.
*H05B 6/72* (2006.01)
*H05B 6/64* (2006.01)

(52) U.S. Cl. ..... 219/761; 219/760

(58) Field of Classification Search ..... 219/268, 219/715, 717, 746; 315/248, 291, 39, 111.21
See application file for complete search history.

(56) References Cited

U.S. PATENT DOCUMENTS 4,063,132 A * 12/1977 Proud et al. ..... 315/248
4,514,706 A * 4/1985 Thompson ..... 331/16
4,642,526 A * 2/1987 Hopkins ..... 315/244
5,723,951 A * 3/1998 Byszewski et al. ..... 315/174
6,924,606 B2 * 8/2005 Yu et al. ..... 315/291
2005/0128750 A1 * 6/2005 Choi et al. ..... 362/263

FOREIGN PATENT DOCUMENTS

| | | |
|---|---|---|
| JP | S56-048094 | 5/1981 |
| JP | H03-117948 | 12/1991 |
| JP | 09-260036 | 10/1997 |
| JP | 11-085472 | 3/1999 |
| JP | 2003-249197 | 9/2003 |

* cited by examiner

*Primary Examiner* — Henry Yuen
*Assistant Examiner* — Hung D Nguyen
(74) *Attorney, Agent, or Firm* — Rankin, Hill & Clark LLP

(57) ABSTRACT

A microwave source system 1 extracts power in a predetermined microwave frequency band out of thermal noise power generated by a resistor (3) by using filter means (4), amplifies the power through a first amplifier (5) and a second amplifier (7), and outputs the power. The first amplifier (5) is variably controllable in gain and control means (6) controls the gain in such a way as to maintain the intensity of the microwave power output from the first amplifier 5 at a predetermined constant value. The second amplifier (7) has a predetermined gain. The resistor (3) is attached to one of the first amplifier (5) and the second amplifier (7), for example, to the second amplifier (7). Thereby, the resistor (3) receives heat from the amplifier (7). Output of the microwave source system (1) is supplied to, for example, a microwave discharge lamp (2). The microwave source system (1) having the above configuration can be compact and inexpensive without a need for a magnetron or a high voltage power supply.

5 Claims, 1 Drawing Sheet

MICROWAVE SOURCE SYSTEM

BACKGROUND OF THE INVENTION

1. Field of the Invention

The present invention relates to a microwave source system which generates and outputs microwave power (an electromagnetic wave in a microwave band).

2. Related Background Art

Microwave power of high energy is used as a wide variety of energy for a microwave discharge lamp, a microwave oven and the like. For example, in the technology disclosed in Japanese Patent Laid-Open No. 2003-249197, microwave power generated by a magnetron is supplied to a microwave discharge lamp to emit the light thereof. The microwave discharge lamp houses an emission cell (bulb) having a light emitting material sealed in the internal space of a resonator which resonates the microwave. The microwave discharge lamp supplies the microwave having a resonance frequency of the resonator to the internal space of the resonator and emits light by exciting the light emitting material in the emission cell by energy of the resonating microwave.

Furthermore, as is well known, the microwave oven heats food with microwave power generated by the magnetron.

The magnetron used for the source of the microwave power in the microwave discharge lamp or microwave oven and the like is relatively expensive and requires a high voltage power supply. Therefore, there has been a problem that it is difficult to reduce the device configuration including the high voltage power supply in size or weight. Furthermore, insulation measures are required against the high voltage power supply, which leads to a problem of easily causing upsizing of the system configuration associated with the insulation measures.

Moreover, the microwave generated by the magnetron is in a narrow band with the center of the band at a predetermined frequency. Therefore, if the resonance frequency of the resonator of the microwave discharge lamp changes due to thermal deformation or load change when the magnetron is used as a microwave source for the microwave discharge lamp, the microwave generated by the magnetron cannot be resonated in some cases. Consequently, light emission from the emitting material may be unsuccessful.

SUMMARY OF THE INVENTION

The present invention has been provided in view of the above background. Therefore, it is an object of the present invention to provide a compact and inexpensive microwave source system which does not require a magnetron or high voltage power supply. Moreover, it is another object of the present invention to provide a microwave source system suitable for stable light emission of the microwave discharge lamp.

To achieve the above object, according to one aspect of the present invention, there is provided a microwave source system comprising: a resistor which generates thermal noise power at least including thermal noise power in a microwave band; a filter means which receives an input of the thermal noise power generated by the resistor and extracts thermal noise power in a predetermined microwave frequency band from the thermal noise power; a first amplifier which has a controllable gain and amplifies the microwave power which is the thermal noise power extracted by the filter means; a control means which detects the intensity of the microwave power output from the first amplifier and controls the gain of the first amplifier in such a way as to maintain the microwave power output from the first amplifier at a predetermined constant intensity according to the detected intensity; and a second amplifier which amplifies the microwave power output from the first amplifier at a predetermined gain and outputs the amplified microwave power as microwave power to be supplied to the outside, wherein the resistor is attached to one of the first amplifier and the second amplifier in such a way as to receive heat generated by the amplifier concerned.

The resistor generally generates thermal noise power depending on its temperature. The frequency distribution of the thermal noise power depends on the frequency characteristic of the resistor. The resistor in the present invention is of a type of resistor that generates thermal noise power including thermal noise power in the microwave band. The thermal noise power generated by the resistor generally includes power in other frequency bands than the microwave band. Note that, however, the filter means extracts the thermal noise power in the predetermined microwave frequency band from the thermal noise power.

According to the present invention, the first amplifier amplifies the microwave power extracted by the filter means, namely the thermal noise power in the predetermined microwave frequency band of the thermal noise power generated by the resistor, first. Furthermore, the second amplifier amplifies the thermal noise power in the predetermined microwave frequency band amplified by the first amplifier. Then, the microwave power output from the second amplifier is finally output to the outside.

The thermal noise power generated by the resistor depends on the temperature of the resistor. Therefore, the intensity of the thermal noise power and then the intensity of the thermal noise power extracted by the filter means (thermal noise power input to the first amplifier) vary in general. The control means, however, controls the gain of the first amplifier in such a way as to maintain the intensity of the microwave power output from the first amplifier at the predetermined constant intensity. Furthermore, the resistor is attached to one of the first amplifier and the second amplifier in such a way as to receive heat generated by the amplifier concerned. Therefore, the resistor is heated and increases in temperature by the heat generated by the first amplifier or the second amplifier during operation of the microwave source system according to the present invention. Therefore, the thermal noise power generated by the resistor gradually increases along with the temperature rise of the resistor. Furthermore, the thermal noise power generated by the first amplifier is also added to the microwave power output from the first amplifier.

As a result thereof, in the steady state during operation of the microwave source system according to the present invention, the first amplifier outputs the microwave power having the predetermined constant intensity. Consequently, the second amplifier outputs microwave power having substantially constant high intensity.

In the present invention, a well-known high-gain amplifier of a gain-variable type can be used for the first amplifier. On the other hand, a well-known power amplifier can be used for the second amplifier. Furthermore, a well-known auto gain control circuit (AGC circuit) can be used for the control means. In addition, a well-known filter circuit and a well-known resistance element can be used for the filter means and the resistor, respectively. Moreover, compact and inexpensive amplifiers, AGC circuits, filter circuits, and resistance elements are commercially available for those in the above. Moreover, these amplifiers and AGC circuits do not require high voltage power supplies as power supplies therefor. Therefore, according to the present invention, a compact and inexpensive microwave source system can be provided without a need for a magnetron or high voltage power supply.

Additionally, it is desirable to increase the intensity of the thermal noise power generated by the resistor in order to increase the intensity of the microwave power (microwave power output from the second amplifier) generated by the microwave source system according to the present invention as much as possible. In this instance, it is preferable to attach the resistor to one reaching a higher temperature of the first amplifier and the second amplifier. Furthermore, in the present invention, generally the second amplifier, which finally amplifies the microwave power, tends to reach a higher temperature than the first amplifier. Therefore, it is desirable to attach the resistor to the second amplifier.

In the microwave source system according to the present invention, the microwave power output from the second amplifier can be supplied to, for example, a microwave discharge lamp, which houses an emission cell having a light emitting material sealed in the internal space of a resonator for resonating the microwave and emits light by exciting the light emitting material in the emission cell by the energy of the microwave resonating in the internal space of the resonator. In this instance, preferably the predetermined microwave frequency band is set to a frequency band including the variation range of the resonance frequency of the resonator of the microwave discharge lamp.

According thereto, even if the resonance frequency of the resonator of the microwave discharge lamp changes due to thermal deformation, load change, or the like, the microwave having an equal frequency to the resonance frequency can be supplied to the microwave discharge lamp. Therefore, the microwave discharge lamp can emit light stably.

The variation range of the resonance frequency of the resonator can be determined, for example, as described below. Specifically, the resonance frequency of the resonator is measured in advance under various environments. Thereafter, the variation range of the resonance frequency of the resonator is previously determined based on the measurement data.

Furthermore, preferably the predetermined microwave frequency band is set to a frequency band including at least a variation range previously determined as a variation range of the resonance frequency caused by a temperature condition of the resonator of the microwave discharge lamp. According thereto, even if the resonance frequency of the resonator changes due to the thermal deformation of the resonator caused by the temperature condition of the resonator, the microwave discharge lamp can emit light stably.

In this instance, the variation range of the resonance frequency caused by the temperature condition can be determined, for example, as described below. Specifically, the resonance frequency of the resonator is measured in advance under various temperature environments supposed in an operating environment of the microwave discharge lamp. Thereafter, the variation range of the resonance frequency of the resonator caused by the temperature condition is determined based on the measurement data.

DETAILED DESCRIPTION OF THE PREFERRED EMBODIMENTS

Figure 1:
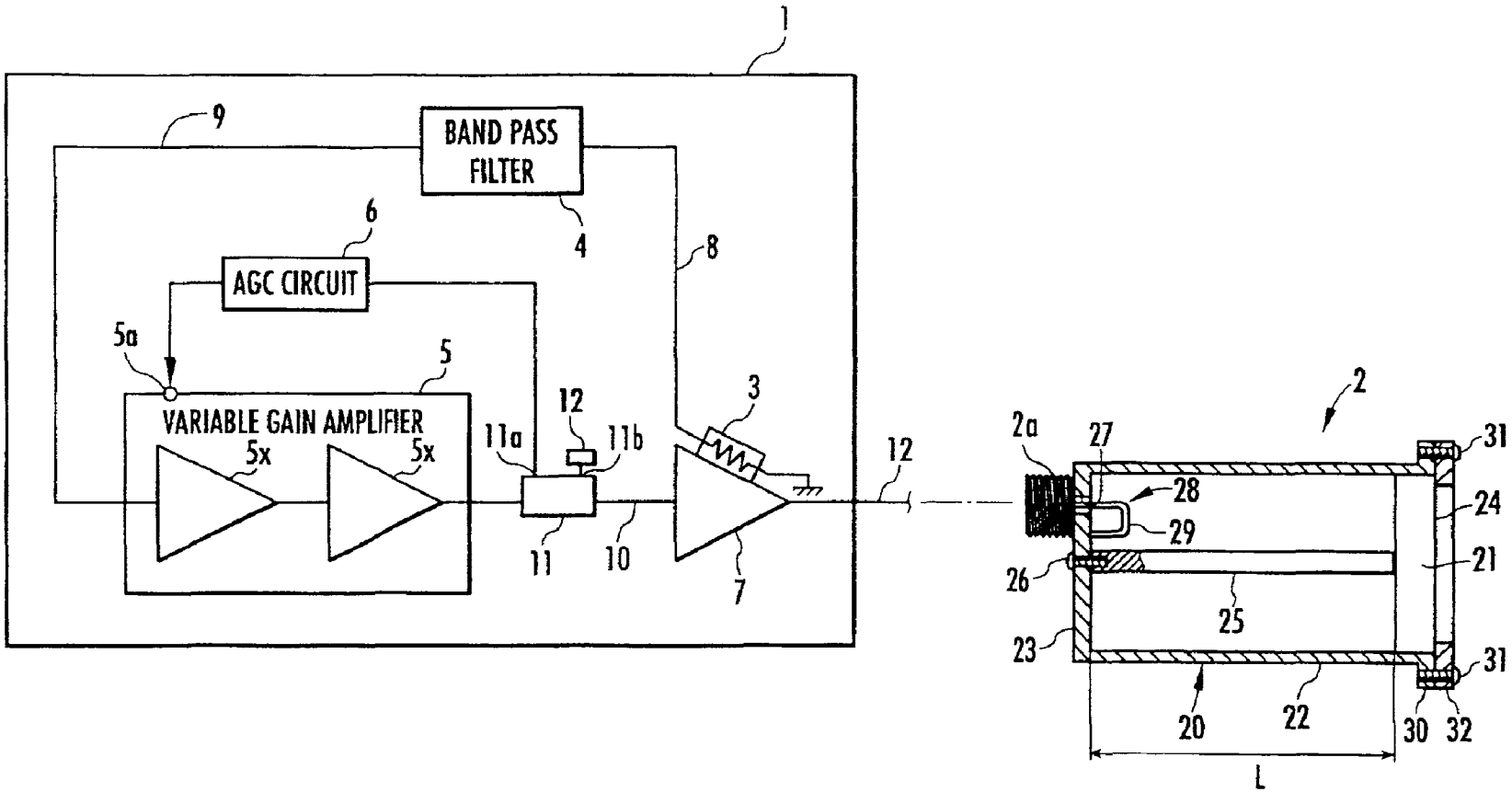
FIG. 1 is a diagram showing the overall configuration of a light source system including a microwave source system according to one embodiment of the present invention and a microwave discharge lamp to which microwave power generated by the microwave source system is supplied.

One embodiment of a microwave source system according to the present invention will be described with reference to FIG. 1.

Referring to FIG. 1, there are shown the microwave source system 1 and a microwave discharge lamp 2. The microwave source system 1 includes a resistor 3 which generates thermal noise power, a band pass filter 4 as filter means, a high-gain amplifier 5 of gain variable type (hereinafter, referred to as variable gain amplifier 5) as a first amplifier, an AGC circuit 6 (auto gain control circuit) as control means, and a power amplifier 7 as a second amplifier.

The resistor 3 is made of, for example, tantalum nitride. The resistance value is set in accordance with a circuit impedance and set to, for example, 50Ω.

In this embodiment, the resistor 3 is attached to the power amplifier 7 with being in contact with the surface section of an outer packaging body of the power amplifier 7, so that heat generated by the power amplifier 7 is transferred to the resistor 3. Moreover, one end of the resistor 3 is grounded and the other end is connected to the input of the band pass filter 4 via a transmission line 8. This allows the thermal noise power generated by the resistor 3 to be input to the band pass filter 4.

The frequency distribution of the thermal noise power generated by the resistor 3 depends on a frequency characteristic (frequency characteristic of a resistance value) of the resistor 3. For example, it is a frequency distribution having frequency components of DC (DC components) to 10 GHz. The thermal noise power includes thermal noise power in the microwave band.

The band pass filter 4 is for use in passing the thermal noise power in a predetermined microwave frequency band out of thermal noise power input to the band pass filter 4. The output of the band pass filter 4 is connected to the input of the variable gain amplifier 5 via a microwave transmission line 9 such as a coaxial cable. This allows microwave power output from the band pass filter 4 (thermal noise power in the microwave band that has passed through the band pass filter 4) to be input to the variable gain amplifier 5.

The variable gain amplifier 5 is variably controllable in gain by a control signal applied to its control input unit 5*a*. The variable gain amplifier 5 amplifies the microwave power input from the band pass filter 4 at the controlled gain and outputs the amplified microwave power. Moreover, the output of the variable gain amplifier 5 is connected to the input of the power amplifier 7 via a microwave transmission line 10 such as a coaxial cable. This allows the microwave power output from the variable gain amplifier 5 to be input to the power amplifier 7. In this embodiment, the variable gain amplifier 5 is composed of a plurality of (two in FIG. 1) element amplifiers 5*x* in order to widen the variation range of the gain thereof.

A directional coupler 11 is placed in the microwave transmission line 10 between the variable gain amplifier 5 and the power amplifier 7. The directional coupler 11 includes a port 11*a* which outputs partial microwave power (microwave power having an intensity proportional to the intensity of the microwave power output from the variable gain amplifier 5, which is referred to as "detection microwave power) of the microwave power input from the variable gain amplifier 5. The above detection microwave power is input from the port 11*a* to the AGC circuit 6 described above. The directional coupler 11 also includes a port 11*b* which outputs partial microwave power of the microwave power on the side of the power amplifier 7. In addition, an appropriate load 12 is connected to the port 11*b*.

The AGC circuit 6 detects the intensity of the microwave power which is output from the variable gain amplifier 5 by the detection microwave power which is input from the directional coupler 11 and controls the gain of the variable gain amplifier 5 according to the detection intensity. In this instance, the AGC circuit 6 generates a control signal applied to the variable gain amplifier 5 in such a way that the intensity of the microwave power output from the variable gain amplifier 5 is equal to a predetermined constant value (hereinafter, referred to as "target power intensity"). Thereafter, the AGC circuit 6 applies the control signal to the control input unit 5*a* of the variable gain amplifier 5. In other words, if the detected intensity of the microwave power output from the variable gain amplifier 5 is lower than the target power intensity, the AGC circuit 6 applies the control signal for increasing the gain of the variable gain amplifier 5 to the control input unit 5*a* of the variable gain amplifier 5. In addition, if the detected intensity of the microwave power output from the variable gain amplifier 5 is higher than the target power intensity, the AGC circuit 6 applies the control signal for decreasing the gain of the variable gain amplifier 5 to the control input unit 5*a* of the variable gain amplifier 5. This allows the AGC circuit 6 to control the gain of the variable gain amplifier 5 in such a way as to maintain the intensity of the microwave power output from the variable gain amplifier 5 at the constant target power intensity.

The power amplifier 7 has a predetermined gain. The power amplifier 7 amplifies the microwave power input from the variable gain amplifier 5 at the predetermined gain and outputs it to the outside. In this embodiment, the microwave power output from the power amplifier 7 of the microwave source system 1 is supplied to the microwave discharge lamp 2. The output of the power amplifier 7 is connected to a microwave input unit 2*a* (a coaxial connector in this embodiment) of the microwave discharge lamp 2 via a microwave transmission line 12 such as a coaxial cable. This allows the microwave power output from the power amplifier 7 to be supplied to the microwave discharge lamp 2 as energy for the microwave discharge lamp 2.

More specifically, the resistor 3, the band pass filter 4, the variable gain amplifier 5, the AGC circuit 6, the directional coupler 11, and the power amplifier 7 can be those well known such as commercially available, for example. Compact ones are available for them. In addition, the variable gain amplifier 5 and the power amplifier 7 each have a frequency characteristic such that the gain is substantially constant at least in the pass frequency band of the band pass filter 4.

The microwave discharge lamp 2 includes a resonator 20 which resonates microwave and an emission cell 21 housed in the internal space (cavity) of the resonator 20. The microwave discharge lamp 2 emits light by exciting the light emitting material sealed in the emission cell 21 by energy of the microwave resonating in the resonator 20.

The following illustratively describes a schematic configuration of the microwave discharge lamp 2 in this embodiment.

The resonator 20 of the microwave discharge lamp 2 is a semi-coaxial resonator in this embodiment. The semi-coaxial resonator 20 includes a cylindrical outer conductor 22, a plate conductor 23 which forms a short-circuit surface at one end of the outer conductor 22, a metal mesh 24 forming a short-circuit surface at the other end of the outer conductor 22, and a round bar-shaped (circular cross sectional) central conductor 25 extending from the plate conductor 23 toward the metal mesh 24 up to the position spaced from the metal mesh 24 in a shaft portion of the outer conductor 22.

In this instance, the plate conductor 23 is integrally formed with the outer conductor 22 at one end of the outer conductor 22 to thereby cover the end of the outer conductor 22. The metal mesh 24 is attached to the other end in such a way as to cover the other end of the outer conductor 22 as described later. The mesh size of the metal mesh 24 is set to a value in such a way that the microwave resonated in the internal space of the semi-coaxial resonator 20 does not pass through the metal mesh 24 (set to a value sufficiently smaller than the wavelength of the microwave).

A central conductor 25 is in contact with the plate conductor 23 at its one end on the side of the plate conductor 23. Furthermore, the central conductor 25 is fastened to the plate conductor 23 with a screw 26 so as to be conducting to the plate conductor 23.

A through-hole 27 is formed at a place between the center of the plate conductor 23 and the periphery thereof. Furthermore, a coaxial connector 2*a* as the microwave input unit 2*a* is attached to the outer surface of the plate conductor 23 coaxially with the through-hole 27. A loop antenna 28 conducting to the central conductor (not shown) of the coaxial connector 2*a* is provided inside the outer conductor 22. The loop antenna 28 is composed of a linear conductor 29 with its one end coupled to the central conductor of the coaxial connector 2*a*. The linear conductor 29 is guided from the central conductor of the coaxial connector 2*a* to the internal space of the outer conductor 22, passing through the through-hole 27. The linear conductor 29 is then bent at its distal end so as to be in contact with the inner surface of the plate conductor 23 and conducting. The loop antenna 28 is formed as described above. The linear conductor 29 is not in contact with the inner peripheral surface of the through-hole 27 and is insulated from the plate conductor 23 at the place of the through-hole 27. Furthermore, the distal end of the linear conductor 29 can be fixed to the plate conductor 23 by soldering or the like.

The emission cell 21 is formed of quartz glass, for example. It contains light emitting material, sealed therein, such as sulfur, mercury, argon gas (Ar), xenon gas (Xe), and the like singly or mixed. The type of the light emitting material is selected according to the wavelength (or frequency) of desired light to be generated by the microwave discharge lamp 2. In this embodiment, the emission cell 21 is formed in a hollow disk shape having substantially the same outside diameter as the inside diameter of the outer conductor 22 of the semi-coaxial resonator 20. The emission cell 21 is housed in the internal space of the outer conductor 22 with one of its both end surfaces abutting the distal end of the central conductor 25 of the semi-coaxial resonator 20 and with being coaxially inserted into the outer conductor 22.

Furthermore, in this embodiment, the metal mesh 24 covers the other end surface of the emission cell 21 with being in close contact with the other end surface. The edge of the metal mesh 24 is brought into contact with the edge on the inner peripheral side of a ring conductive supporting member 32 fastened with a plurality of screws 31 to a flange 30 formed on the outer periphery of the other end of the outer conductor 22. In this condition, the metal mesh 24 and the emission cell 21 are held with being put between the conductive supporting member 32 and the central conductor 25. Thereby, the metal mesh 24 is attached to the other end of the outer conductor 22 in such a way as to cover the other end thereof. In addition, the metal mesh 24 is conducting to the outer conductor 22 via the conductive supporting member 32.

The "light" generated by the microwave discharge lamp 2 is not limited to visible light. The "light" can be an electromagnetic wave in the ultraviolet region or in the THz region (more specifically, an electromagnetic wave that can be generated from the light emitting material and having a sufficiently shorter wavelength than the microwave).

In the microwave discharge lamp 2 having the above configuration, the microwave is radiated into the internal space of the resonator 20 via the loop antenna 28 when the microwave having a frequency substantially equal to the resonance frequency of the resonator (semi-coaxial resonator) 20 is supplied to the coaxial connector 2*a*. The radiated microwave is electromagnetically coupled to the central conductor 25 and resonates in the internal space of the resonator 20. Then, the energy of the resonating microwave excites the light emitting material in the emission cell 21 to thereby emit light. Furthermore, the light generated from the light emitting material passes through the metal mesh 24 and is released to the outside of the resonator 20. In this instance, the resonator 20 is the semi-coaxial resonator and therefore the resonance frequency depends on the length L of the central conductor 25 of the resonator 20 (more specifically, the length from the internal surface of the plate conductor 23 to the distal end of the central conductor 25). Specifically, assuming that $\lambda$ is the wavelength of the microwave, the resonance frequency of the resonator 20 equals the frequency of the microwave satisfying the condition that the odd multiple of $\lambda/4$ is substantially equal to the length L of the central conductor. Moreover, the bandwidth of the resonance frequency (the bandwidth of frequency where the microwave can resonate in the resonator 20) is a narrow band. The bandwidth is, for example, in the order of 1 MHz.

Additionally, the metal mesh 24 can also be previously attached to the conductive supporting member 32. Furthermore, if the light generated in the emission cell 21 is visible light, the resonator 20 can be configured as described below. For example, a transparent conductive film (so-called ITO film) is firmly fixed to an end surface of the emission cell 21 (the end surface on the side opposite to the central conductor 25) to bring the transparent conductive film into conduction to the outer conductor 22. In addition, the transparent conductive film forms a short-circuit surface on the side of the other end of the outer conductor 22 (on the side opposite to the plate conductor 23), instead of the metal mesh 24.

Moreover, the outer conductor 22 can be formed of a metal mesh. Furthermore, the resonator 20 of the microwave discharge lamp 2 need not be the semi-coaxial resonator, but can be, for example, a coaxial resonator. Still further, the microwave to the microwave discharge lamp 2 can be supplied via a wave guide.

The following describes a relation between the resonance frequency of the resonator 20 (the semi-coaxial resonator 20 in this embodiment) of the microwave discharge lamp 2 and the pass frequency band (the predetermined microwave frequency band) of the band pass filter 4.

Since the resonator 20 of the microwave discharge lamp 2 is the semi-coaxial resonator in this embodiment, the resonance frequency of the resonator 20 depends on the length L of the central conductor 25 as described above. In this instance, if no thermal expansion or the like occurs in the central conductor 25 and the resonance frequency of the resonator 20 is always maintained at a constant level, the frequency of the microwave supplied from the power amplifier 7 of the microwave source system 1 to the microwave discharge lamp 2 only needs to be a constant frequency substantially equal to the resonance frequency of the resonator 20. Therefore, in that case, the pass frequency band of the band pass filter 4 is set to a narrow band (of the order of 1 MHz) with the center at the resonance frequency of the resonator 20.

Practically, however, the resonance frequency of the resonator 20 changes in some cases due to the effect of the thermal expansion or the like of the central conductor 25 accompanying heat generation at light emission of the microwave discharge lamp 2. This variation of the resonance frequency is a phenomenon that can occur similarly when the coaxial resonator is used as the resonator. In that case, if the pass frequency band of the band pass filter 4 is set to the narrow band described above, the resonator 20 cannot resonate the microwave output from the power amplifier 7 of the microwave source system 1 at the occurrence of variation of the resonance frequency of the resonator 20. Consequently, the microwave discharge lamp 2 cannot emit light.

Therefore, in this embodiment, the pass frequency band of the band pass filter 4 is set in consideration of the variation of the resonance frequency of the resonator 20 as described above. In other words, the pass frequency band of the band pass filter 4 is set in such a way that the variation range of the resonance frequency of the resonator 20 stays within the pass frequency band of the band pass filter 4. In this instance, the variation range of the resonance frequency of the resonator 20 is specified as described below, for example. Specifically, regarding a plurality of microwave discharge lamps having the same specification as the microwave discharge lamp 2, the resonance frequency of the resonator of each microwave discharge lamp is previously measured under various temperature environments (temperature environments supposed in the operating environment of the microwave discharge lamp 2). Thereafter, the variation range of the resonance frequency of the resonator 20 is determined based on the measurement data. A variation range of the resonance frequency caused by a temperature condition of the resonator 20 can be determined by determining the variation range of the resonance frequency in this manner. It is also possible to determine the variation range of the resonance frequency in consideration of the variation of the resonance frequency caused by a factor other than the temperature condition as well as the temperature condition of the resonator 20.

The following describes the operation of a light source system in this embodiment, focusing on the operation of the microwave source system 1.

Upon start-up of the microwave source system 1 with power supply to the variable gain amplifier 5, the power amplifier 7, and the AGC circuit 6 of the microwave source system 1, thermal noise power (microwave power) in the pass frequency band of the band pass filter 4 of the thermal noise power generated by the resistor 3 is input to the variable gain amplifier 5 via the band pass filter 4. Then, the variable gain amplifier 5 amplifies the input thermal noise power (microwave power). Note here that the thermal noise power generated by the variable gain amplifier 5 is then added to the microwave power output from the variable gain amplifier 5 as well as the amplified microwave power input to the variable gain amplifier 5.

Furthermore, the microwave power output from the variable gain amplifier 5 is input to the power amplifier 7 and the power amplifier 7 amplifies the microwave power. Thereafter, the microwave power output from the power amplifier 7 is supplied to the microwave discharge lamp 2.

If the temperature of the power amplifier 7 or the like is relatively low immediately after the start-up of the microwave source system 1 in the above, the resistor 3 or the variable gain amplifier 5 generates only small amounts of thermal noise power. Therefore, generally the intensity of the microwave power output from the variable gain amplifier 5 is less than the target power intensity. Thus, the AGC circuit 6 increases the gain of the variable gain amplifier 5.

On the other hand, the temperature of the power amplifier 7 gradually rises up with the amplification of the output from the variable gain amplifier 5. Along with this, the thermal noise power generated by the resistor 3 increases, too. Furthermore, the temperature of the variable gain amplifier 5 also increases and therefore the thermal noise power generated by the variable gain amplifier 5 increases, too. Consequently, the intensity of the microwave power output from the variable gain amplifier 5 finally increases up to the target power intensity. Thereafter, the AGC circuit 6 variably controls the gain of the variable gain amplifier 5 so that the intensity of the microwave power output from the variable gain amplifier 5 is maintained at the target power intensity.

If the intensity of the microwave power output from the variable gain amplifier 5 is successfully maintained at the target power intensity as described above, the power amplifier 7 outputs substantially constant high-intensity microwave power. The microwave is then supplied to the microwave discharge lamp 2. Furthermore, the microwave, which is supplied and whose frequency is substantially equal to the resonance frequency of the microwave discharge lamp 2, resonates in the resonator 20 of the microwave discharge lamp 2. The energy of the resonating microwave excites the light emitting material in the emission cell 21 and thereby it emits light. The light (not limited to visible light) is released from the microwave discharge lamp 2.

In this instance, the band for the microwave output from the power amplifier 7 of the microwave source system 1 is substantially the same band as the entire band of the pass frequency band of the band pass filter 4. The band includes the variation range of the resonance frequency of the resonator 20 of the microwave discharge lamp 2. Therefore, even if the resonance frequency of the resonator 20 changes due to thermal deformation or the like of the central conductor 25 of the resonator 20, the microwave having a frequency substantially equal to the resonance frequency after the change can be supplied to the resonator 20 of the microwave discharge lamp 2. Therefore, even in the case of a change in the resonance frequency of the resonator 20 of the microwave discharge lamp 2, the microwave discharge lamp 2 can emit light stably.

Elaborating on the above description, it is assumed that Bp is a band width of the microwave output from the power amplifier 7 (nearly equal to the width of the pass frequency band of the band pass filter 4) and Bc is the bandwidth of the resonance frequency of the resonator 20 (of the order of 1 MHz). In this condition, the intensity of the microwave power actually supplied from the microwave source system 1 to the microwave discharge lamp 2 (the microwave power resonating in the resonator 20 of the microwave discharge lamp 2) is equal to the intensity of the microwave power output from the power amplifier 7 multiplied by Bc/Bp (<1).

A specific numerical example for the above will be described below.

It is assumed that the pass frequency band of the band pass filter 4 is set to a microwave band of 2448.5 MHz to 2451.5 MHz, for example. The bandwidth Bp (=3 MHz) of the pass frequency band is set with estimating a variation of the resonance frequency of the resonator 20 of the microwave discharge lamp 2 as described above. In other words, the bandwidth Bp is set in such a way that the variation range of the resonance frequency of the resonator 20 stays within the pass frequency band. If the pass frequency band is set in a high frequency range within the microwave band, a transmission loss increases in the microwave transmission line. Therefore, it leads to upsizing of the system because of a need for using a large cable and to an increase in cost undesirably. If the pass frequency band is set in a low frequency range within the microwave band, it leads to upsizing of the microwave discharge lamp 2, particularly the central conductor 25 and to an increase in cost undesirably. Therefore, when the microwave source system 1 is used for the microwave discharge lamp, the range of the pass frequency band is preferably set to the above range.

Furthermore, it is assumed that the gain of the variable gain amplifier 5 can be changed within a range of 110 dB to 150 dB. In addition, the gain of the variable gain amplifier 5 is assumed to be controlled to be 130 [dB] in the steady state during operation of the microwave source system 1. The noise figure of the variable gain amplifier 5 in the steady state is then assumed to be, for example, 20 [dB].

Furthermore, the gain of the power amplifier 7 is assumed to be, for example, 10 [dB]. In addition, the temperature (the temperature on the absolute temperature scale) of the power amplifier 7 is assumed to be, for example, 353 [K] (=80[° C.]) in the steady state during operation of the microwave source system 1.

On the other hand, assuming that P [W] is the intensity (power value) of the thermal noise power generated by the resistor 3, P is generally obtained by the following equation (1):

[Eq. 1]

$$P=K\times T\times B \tag{1}$$

where K is a Boltzmann constant (=$1.38\times10^{-23}$ [J/K]), T is a temperature [K] of the resistor 3 on the absolute temperature scale, and B is a frequency band width [Hz].

In this instance, the bandwidth Bp of the pass frequency band of the band pass filter 4 is 3 MHz as described above. Therefore, the intensity (power value) of the thermal noise power (the thermal noise power in the microwave band) input from the band pass filter 4 to the variable gain amplifier 5 is equal to the value of P when T=353 [K] and B=$3\times10^{6}$ [Hz] are assumed in the above equation (1) in the steady state during operation of the microwave source system 1. Accordingly, in this embodiment, the intensity of the thermal noise power in the microwave band input to the variable gain amplifier 5 is calculated as follows: ($1.38\times10^{-23}$ [J/K])×353 [K]×($3\times10^{6}$ [Hz])=$1.46\times10^{-14}$ [W](=−108.35 [dBm]). The relation between the power unit [W] and [dBm] is defined by the following equation (2) with Q as an arbitrary value:

[Eq. 2]

$$\begin{aligned} Q[W] &= 10\times\log_{10}(Q\times1000)[dBm] \\ &= 10\times\log_{10}Q+30[dBm] \end{aligned} \tag{2}$$

Therefore, in this embodiment, the intensity of the microwave power output from the variable gain amplifier 5 in the steady state (the total sum of the thermal noise power input to the variable gain amplifier 5 amplified at a gain of 130 dB and the thermal noise power generated by the variable gain amplifier 5 at a noise figure of 20 dB), namely the microwave power input to the power amplifier 7 is calculated as follows: −108.35 [dBm]+(130 [dB]+20 [dB])=41.65 [dBm](=14.62 [W]).

Furthermore, in this embodiment, the intensity of the microwave power output from the power amplifier 7 in the steady state (the microwave power input to the power amplifier 7 amplified at a gain of 10 dB) is calculated as follows: 41.65 [dBm]+10 [dB]=51.65 [dBm](=146.22 [W]).

In this manner, the microwave source system 1 according to this embodiment can output a microwave having a power intensity of 146.22 [W] (the microwave obtained by amplifying thermal noise power in the microwave band substantially equivalent to the pass frequency band of the band pass filter 4) by setting the pass frequency band of the band pass filter 4, the gain of the variable gain amplifier 5, and the gain of the power amplifier 7 as described above. In this instance, the target power intensity of the microwave power output form the variable gain amplifier 5 is set to 14.62 [W].

The bandwidth of the microwave output from the power amplifier 7 is substantially equal to the bandwidth Bp (=3 MHz) of the pass frequency band of the band pass filter 4. In addition, the bandwidth Bc of the resonance frequency of the resonator 20 of the microwave discharge lamp 2 is in the order of 1 MHz as described above. Therefore, in this embodiment, the microwave power practically supplied from the microwave source system 1 to the resonator 20 of the microwave discharge lamp 2 (the power intensity of the microwave resonating in the resonator 20) is calculated as follows: 51.65 [dBm]+10×$\log_{10}$ (Bc/Bp) [dB]=51.65 [dBm]−4.77 [dB]=46.88 [dBm](=146.22 [W]×(Bc/Bp)=48.74 [W]). Therefore, it is possible to supply the microwave power having sufficiently high intensity to excite the light emitting material in the emission cell 21 for emitting light to the microwave discharge lamp 2.

As described above, according to the microwave source system 1 applied to the light source system in this embodiment, the thermal noise power generated by the resistor 3 is used. This allows the generation of a microwave having sufficiently high intensity (substantially constant intensity) to emit light in the microwave discharge lamp 2 with a simple and compact configuration using the resistor 3, the band pass filter 4, the variable gain amplifier 5, the AGC circuit 6, and the power amplifier 7 without a need for a high voltage power supply or a magnetron.

Furthermore, in this embodiment, the pass frequency band of the band pass filter 4 is set with estimating a variation of the resonance frequency of the resonator 20 of the microwave discharge lamp 2. Therefore, even if the resonance frequency of the resonator 20 varies, the microwave can be resonated in the resonator 20 properly and the microwave discharge lamp 2 can emit light stably.

The above embodiment has been described by taking the case where the microwave source system 1 is used as a microwave source for the microwave discharge lamp 2 for example. The usage of the microwave source system 1, however, is not limited thereto. For example, it is also possible to further increase the intensity of the microwave power output from the power amplifier 7 of the microwave source system 1 so as to use the microwave source system 1 as a microwave source for a microwave oven or the like.

In addition, while the resistor 3 is attached to the power amplifier 7 in this embodiment, it can be attached to the variable gain amplifier 5. In order to increase the intensity of the microwave power output from the power amplifier 7 of the microwave source system 1, however, it is preferable to attach the resistor 3 to one reaching a higher temperature of the power amplifier 7 and the variable gain amplifier 5.

What is claimed is:

1. A microwave source system comprising:

a resistor attached to one of a plurality of amplifiers such that the resistor is in direct contact with a surface section of an outer packaging body of one of the plurality of amplifiers to thereby receive heat generated by one of the plurality of amplifiers to thereby generate thermal noise power;

a filter means which receives an input of the thermal noise power generated by the resistor and extracts thermal noise power in a predetermined microwave frequency band from the thermal noise power;

the plurality of amplifiers including:

a first amplifier which has a controllable gain and amplifies microwave power, which is the thermal noise power extracted by the filter means; and a second amplifier which amplifies the microwave power output from the first amplifier at a predetermined gain and outputs the amplified microwave power as microwave power to be supplied to the outside, and a control means which detects the intensity of the microwave power output from the first amplifier and controls the gain of the first amplifier in such a way as to maintain the microwave power output from the first amplifier at a predetermined constant intensity according to the detected intensity.

2. A microwave source system according to claim 1, wherein the resistor is attached to one reaching a higher temperature of the first amplifier and the second amplifier.

3. A microwave source system according to claim 1, wherein the resistor is attached to the second amplifier.

4. A microwave source system according to claim 1, wherein the microwave power output from the second amplifier is supplied to a microwave discharge lamp, which houses an emission cell having a light emitting material sealed in the internal space of a resonator for resonating the microwave and emits light by exciting the light emitting material in the emission cell by energy of the microwave resonating in the internal space of the resonator and wherein the predetermined microwave frequency band is set to a frequency band including a variation range of a resonance frequency of the resonator of the microwave discharge lamp.

5. A microwave source system according to claim 4, wherein the predetermined microwave frequency band is set to a frequency band including at least a variation range previously determined as a variation range of the resonance frequency caused by a temperature condition of the resonator of the microwave discharge lamp.

* * * * *